US005333992A

United States Patent [19]

Kane et al.

[11] Patent Number: 5,333,992

[45] Date of Patent: Aug. 2, 1994

[54] COOLABLE OUTER AIR SEAL ASSEMBLY FOR A GAS TURBINE ENGINE

[75] Inventors: Daniel E. Kane, Tolland; Donald E. Haddad, Amston, both of Conn.

[73] Assignee: United Technologies Corporation, Hartford, Conn.

[21] Appl. No.: 14,033

[22] Filed: Feb. 5, 1993

[51] Int. Cl.[5] ..... F01D 25/26

[52] U.S. Cl. ..... 415/138; 415/173.1

[58] Field of Search ..... 415/115, 116, 134, 630, 415/173.1

[56] References Cited

U.S. PATENT DOCUMENTS

| | | | |
|---|---|---|---|
| 4,573,866 | 3/1986 | Sandy, Jr. et al. | 415/173.1 |
| 4,650,394 | 3/1987 | Weidner | 415/115 |
| 4,650,395 | 3/1987 | Weidner | 415/173.1 |
| 4,759,687 | 7/1988 | Miraucourt et al. | 415/138 |
| 5,088,888 | 2/1992 | Bobo | 415/138 |
| 5,165,847 | 11/1992 | Proctor et al. | 415/115 |
| 5,167,485 | 12/1992 | Starkweather | 415/138 |
| 5,169,287 | 12/1992 | Proctor et al. | 415/115 |

*Primary Examiner*—Edward K. Look
*Assistant Examiner*—Mark Sgantozos

[57] ABSTRACT

A coolable outer air seal assembly for a gas turbine engine is disclosed. Various construction details are developed which provide an outer air seal assembly comprised of a plurality of seal segments including bumpers adapted to maintain adequate cooling fluid flow through the clearance gap between adjacent seal segments. In one particular embodiment, each seal segment includes a mating surface having a plurality of bumpers disposed adjacent to cooling fluid channel outlets and an axially extending ridge disposed along the radially outer edge of the mating surface. The bumpers extend circumferentially a distance $H_b$ to maintain a minimum opening $G_{min}$ between adjacent seal segments and extend a radial distance $W_b$ to restrict fluid from flowing axially through the clearance gap. The ridge extends radially outward to define in part a seal edge for engaging a feather seal.

20 Claims, 4 Drawing Sheets

COOLABLE OUTER AIR SEAL ASSEMBLY FOR A GAS TURBINE ENGINE

DESCRIPTION

1. Technical Field

This invention relates to gas turbine engines, and more particularly to turbine outer air seal assemblies.

2. Background of the Invention

A typical gas turbine engine has an annular axial flow path for conducting working fluid sequentially through a compressor section, a combustion section, and a turbine section. The compressor section includes a plurality of rotating blades which add energy to the working fluid. The working fluid exits the compressor section and enters the combustion section. In the combustion section, fuel is mixed with the compressed working fluid and the mixture is ignited. The resulting products of combustion are then expanded through the turbine section. The turbine section includes a plurality of rotating blades which extract energy from the expanding fluid. A portion of this extracted energy is transferred back to the compressor section via a rotor shaft interconnecting the compressor section and turbine section. The remainder of the energy may be used for other functions.

In general, the work output of the gas turbine engine is proportional to the temperature of the products of combustion within the combustor section. Material characteristics and structural loading of the turbine section limit the operational temperature of the products of combustion. One common method of extending the operational temperature range of the turbine section, and thereby increasing the work output of the gas turbine engine, is to provide cooling of the turbine section components using a portion of the compressor section fluid. This cooling fluid bypasses the combustion process. While cooling extends the temperature range of the turbine section and the service life of the turbine section components, extracting compressor fluid reduces the overall efficiency of the gas turbine engine. The reduction in efficiency is caused by the cooling fluid circumventing a portion of the blades within the turbine section, thereby resulting in no transfer of energy between the cooling fluid and those blades. Therefore, the increased output of the gas turbine engine must be balanced against the reduced efficiency caused by bypassing the combustion section and a portion of the turbine section with the cooling fluid.

Efficient operation of the gas turbine engine depends upon many events. One of the more significant events is the interaction between the rotor blades of the turbine and the expanding combustion products. The rotor blades are part of a rotor assembly which includes a rotor disk to which the blades and the rotor shaft are attached. Each rotor blade includes a root portion connected to the rotor disk and an airfoil portion. The airfoil portion extends across the working fluid flow path. The airfoil shape of the blade permits the blade to engage the expanding combustion products resulting in energy being transferred from the fluid to the blade.

Efficient transfer of energy between the working fluid and the rotor blades is dependant in part upon confining the flow of working fluid to the airfoil portion of the rotor blades. This is accomplished at the radially inner end of the blades by a blade platform and at the radially outer end by an outer air seal assembly. The blade platform provides a radially inner flow surface at the base of the airfoil portion. The outer air seal assembly defines a flow surface radially outward of the outer tip of the blades.

A typical outer air seal assembly includes a plurality of arcuate segments spaced circumferentially about the rotor assembly. Each segment has a radially inward facing flow surface which is in close proximity to the tip of the blades rotating about the axis. The radial separation between the blade tip and the flow surface of the seal defines a radial clearance. The flow surfaces of the segments are in direct contact with the hot working fluid flowing through the turbine section. As a result, the outer air seal assembly requires cooling to maintain the temperature of the segments within acceptable limits.

The size of the radial clearance is kept to a minimum to reduce the amount of working fluid which flows through the radial clearance without engaging the airfoil portion of the blade. An initial radial clearance is provided to minimize destructive interference between the blade tip and segment. During operation, the size of the radial clearance varies with the temperature of the outer case structure. This fluctuation in clearance gap is due to the differing rates of thermal expansion of the turbine structures. Actively cooling the outer case structure minimizes the radial clearance by causing the outer case to contract and thereby causing the outer air seal assembly to contract. Buckling or binding of the assembly is prevented by having a plurality of individual segments. An example of such a construction is shown in U.S. Pat. No. 4,650,394 issued to Weidner and entitled "Coolable Seal Assembly for a Gas Turbine Engine".

As disclosed in Weidner, cooling fluid is flowed radially inward through openings between adjacent seal segments. This cooling fluid then flows over the flow surface of the segments. The openings are dynamic in that the size of the opening changes with the temperature of the air seal assembly and outer case. This configuration optimizes the amount of compressor discharge air required for cooling of the air seal assembly. As mentioned previously, minimizing the amount of compressor discharge air which bypasses the combustion section maximizes the efficiency of the gas turbine engine.

The above art notwithstanding, scientists and engineers under the direction of Applicants' Assignee are working to develop coolable outer air seal assemblies which minimize the use of compressor discharge air.

DISCLOSURE OF THE INVENTION

The present invention is predicated in part upon the recognition that improved cooling methods are required for turbines to operate in the temperature environments of high output turbomachines and that such cooling methods may involve cooling channels through the segments. One such cooling scheme is disclosed in co-pending commonly assigned patent application entitled "Super Cooled Turbine Blade Outer Air Seal with Optimized Cooling and Fabrication" submitted concurrently by Mack et al.

According to the present invention, a bumper is disposed on the lateral edge of adjacent seal segments to provide means to maintain a minimum spacing between adjacent segments. The bumper prevents blockage of fluid flow between adjacent seal segments.

According to one embodiment of the present invention, an outer air seal assembly includes a plurality of seal segments circumferentially spaced and separated by a clearance gap G, each segment including a plurality of bumpers disposed on and extending circumferentially therefrom, wherein the bumpers provide means to prevent the clearance gap $G_{min}$. The minimum gap $G_{min}$ is selected to permit from closing to less than a predetermined minimum gap adequate cooling fluid to flow through the clearance gap. Each seal includes a plurality of axially spaced channels, each channel defining a cooling fluid flow passage. The plurality of bumpers are axially spaced along a lateral edge with each bumper disposed adjacent to one of the channels.

According to another embodiment of the present invention, the bumper includes an axially extending ridge disposed radially outwardly of the channels, wherein the ridge extends radially outward to a seal land. The seal land provides a mating surface for a feather seal extending between adjacent seal segments. The ridge in conjunction with the seal land forms a sealing edge which engages the feather seal. This engagement prevents a breach in the event of the seal segments becoming radially misaligned.

A principle feature of the present invention is the bumpers sized to maintain a minimum separation between adjacent segments of the outer air seal assembly. A feature of one embodiment of the present invention is the axial spacing of the bumpers between adjacent channels. A further feature is the radial extension of the bumpers to block fluid from flowing axially through the clearance gap. A feature of another embodiment is the ridge extending axially along the radially outer edge of the clearance gap to define the sealing edge.

A primary advantage of the present invention is the effective cooling of the outer air seal segments as a result of the maintenance of a minimum clearance gap between adjacent segments to permit adequate cooling flow through the clearance gap. An advantage of one embodiment is efficiency of the gas turbine engine which results from the efficient transfer of heat as the cooling fluid passes through the channels, exits the channel outlets separated by bumpers, and out through the clearance gap defined by the bumpers. The cooling fluid within the gap cools the circumferential edges of the substrate and the coating layers to prevent destructive thermal gradients in this region. An advantage of another embodiment is the efficiency of the gas turbine engine which results from the radially extending bumpers and axially extending ridge restricting the axial flow of working fluid through the clearance gap. Restricting axial flow within the clearance gap encourages the cooling fluid to flow radially inward into the flow path.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
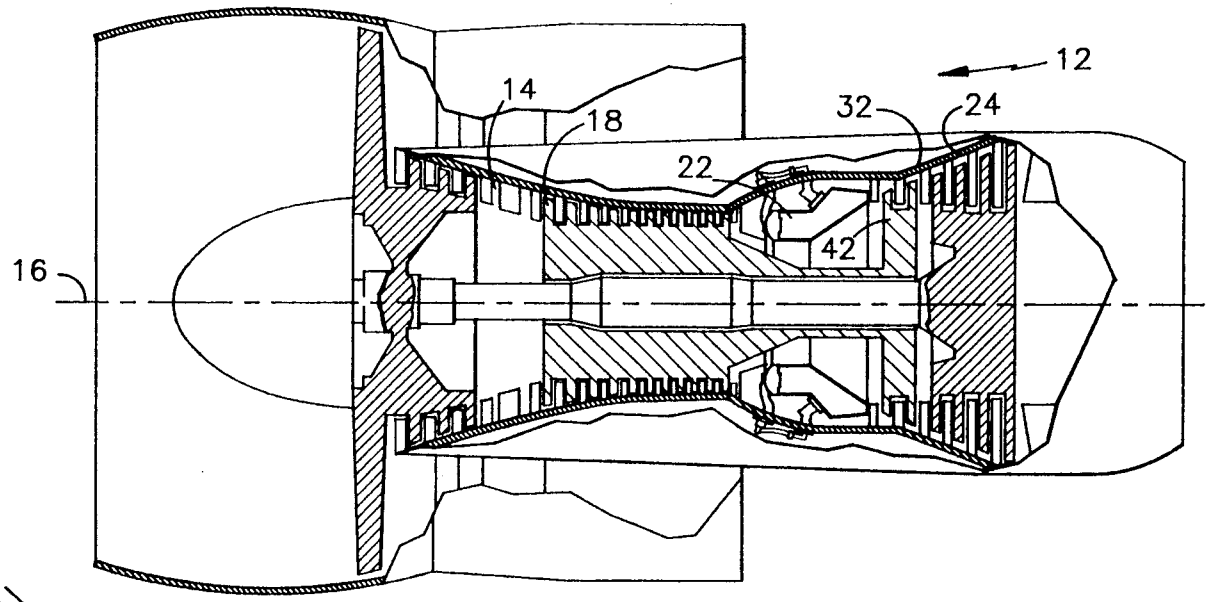
FIG. 1 is a sectional side view of a gas turbine engine.

FIG. 1 is an illustration of a gas turbine engine 12 shown as a representation of a typical turbomachine. The gas turbine engine includes a working fluid flowpath 14 disposed about a longitudinal axis 16, a compressor section 18, a combustion section 22, and a turbine section 24.

Figure 2:
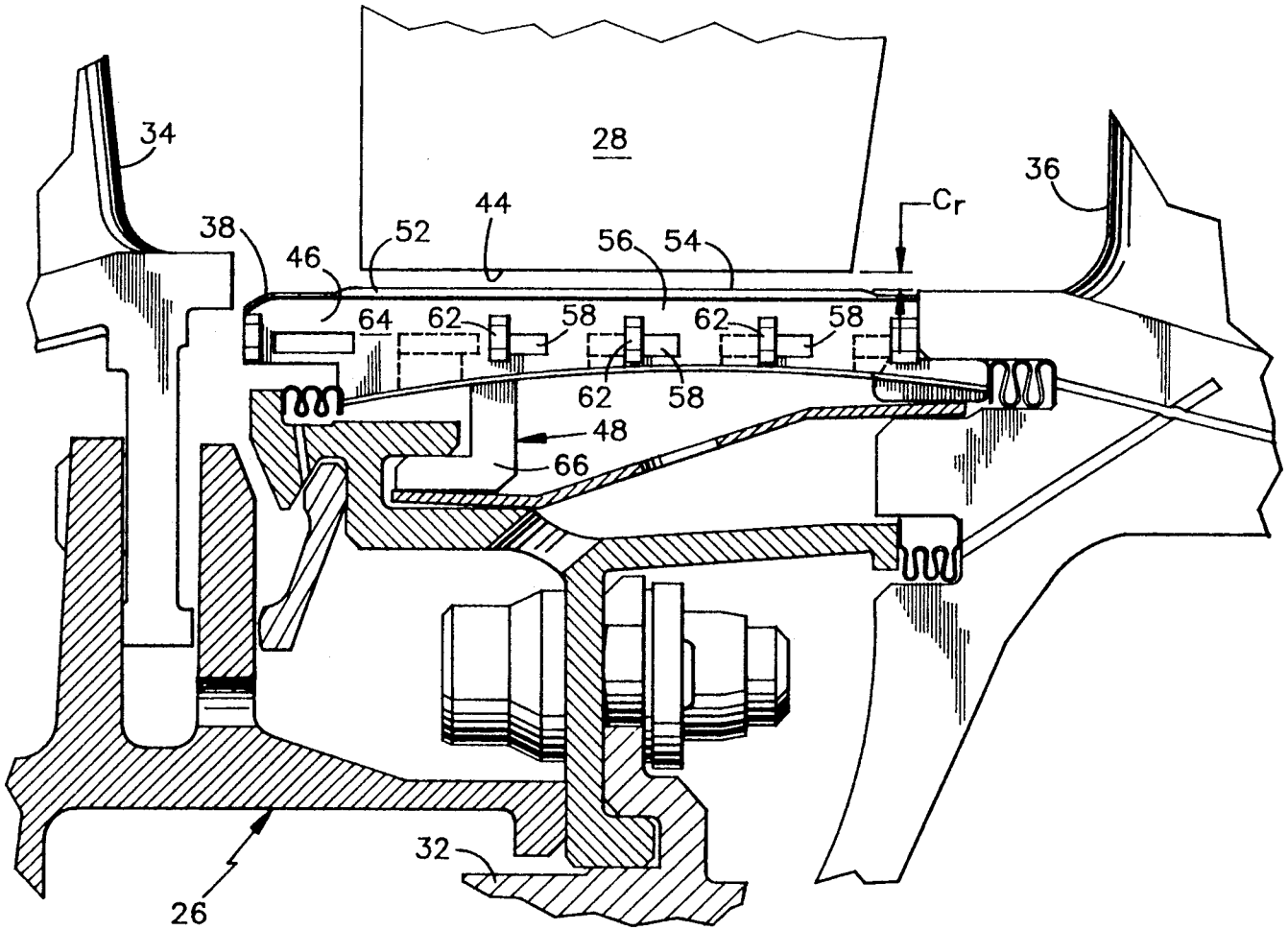
FIG. 2 is a cross-sectional view of a portion of a turbine section illustrating rotor blade and a stator assembly including an arcuate seal segment of an outer air seal assembly.

Referring to FIG. 2, a turbine stator assembly 26, one of a plurality of rotor blades 28, and the working fluid flowpath are shown. The stator assembly includes a casing 32 that circumscribes the turbine section, a plurality of first vanes 34, a plurality of second vanes 36, and an outer air seal assembly 38. The first vanes are disposed axially upstream of the rotor blades and extend through the flowpath. The second vanes extend through the flowpath axially downstream of the rotor blades. Each of the rotor blades extends radially outwardly from a turbine rotor 42 (see FIG. 1) through the working fluid flow path and includes a blade tip 44 in radial proximity to the outer air seal assembly.

The outer air seal assembly includes a plurality of seal segments 46 which are circumferentially spaced and circumscribe the plurality of rotor blades. Each of the seal segments is positioned on the stator assembly by attachment means 48. The seal segment includes a coating layer 52 having a seal surface 54 facing radially inwardly, a base 56, a plurality of channels 58 extending circumferentially through the base, and a plurality of bumpers 62 disposed on a mating surface 64.

The radial separation between the seal surface and the blade tip defines a radial clearance $C_r$. This radial clearance $C_r$ is minimized to block the flow of working fluid between the tip of the rotor blade and the seal surface. Blocking the flow through the radial clearance maximizes the interaction of the working fluid and the airfoil shaped blade. Maximizing the interaction between the working fluid and the rotor blade maximizes the efficiency of the gas turbine engine.

The base extends axially between the first stator vane and the second stator vane and circumferentially mates to adjacent seal segments. The base provides support structure for the seal surface and the attachment means. As shown in FIG. 2, the attachment means includes a plurality of radially outward hooks 66 disposed on the radially outer end of the base and engaged with the stator assembly. The extensions axially and radially retain the seal segment to the stator assembly.

Figure 7:
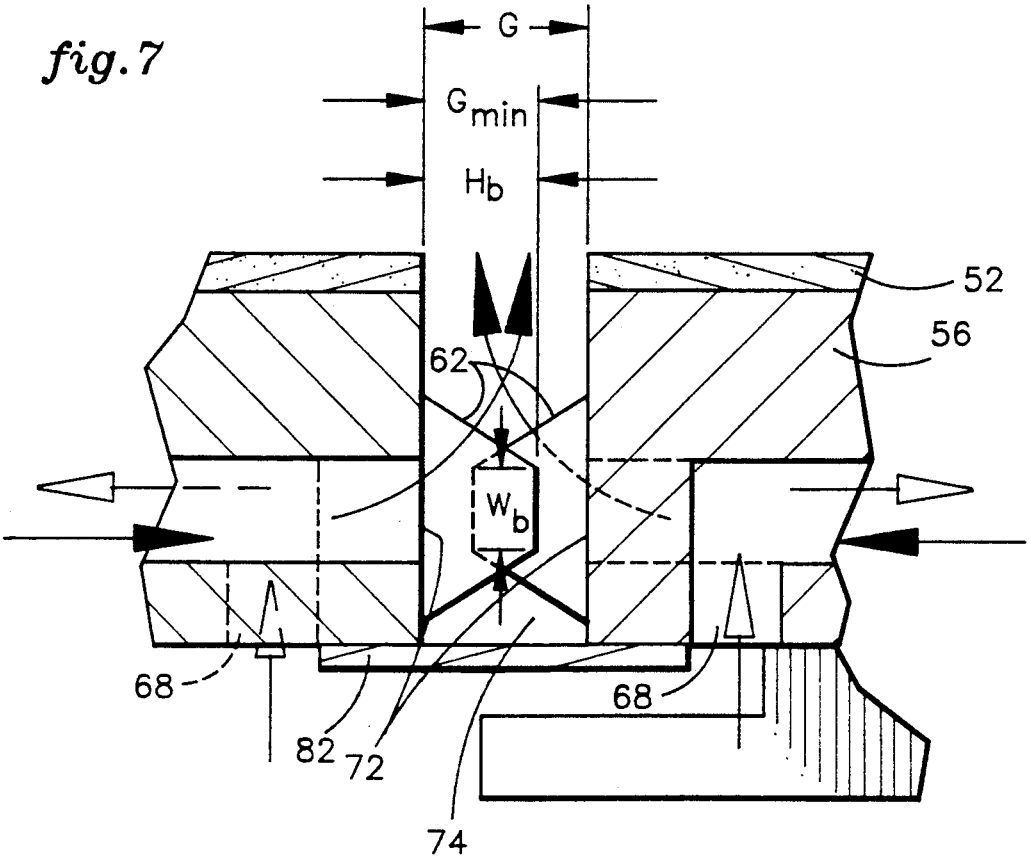
FIG. 7 is an illustration of the flow of cooling fluid within the seal segments through the clearance gap and into the flow path.

The plurality of channels include an inlet 68 and an outlet 72 (see FIG. 7). The inlet is disposed on the radially outer surface of the base (see FIG. 7) and in fluid communication with a source of pressurized cooling fluid. Although not shown, the source of pressurized cooling fluid is typically a portion of the compressor section working fluid that bypasses the combustor section. This cooling fluid flows through passages in the stator assembly to the inlets of the channels. The cooling fluid flowing through the channels exits the channels through the outlet. The cooling fluid exiting the outlet is injected into the region 74 between adjacent seal segments (see FIG. 4*a*).

The cooling fluid which passes through the stator assembly cools the stator assembly to maintain the temperature below the allowable temperature of the stator assembly as determined by material considerations. Another effect of cooling is the radial contraction of the casing. As the casing cools it contracts radially inward to thereby bring the seal surface into closer proximity with the blade tip. Therefore, cooling the casing closes the radial clearance $C_r$ and, as a result, decreases the amount of working fluid escaping around the blade and increases the efficiency of the gas turbine engine Since the cooling fluid is drawn from the compressor section, any increase in the amount of fluid bypassing the combustor section will adversely affect the overall efficiency of the gas turbine engine. Effective and efficient use of the cooling fluid minimizes the amount of cooling fluid required for adequate cooling.

As shown in FIG. 7, cooling fluid enters the channels through the inlets, flows through the passages defined by the channels, and exits the channel through the outlet. As the fluid flows through the channel, heat is transferred from the seal segment to the fluid. Cooling fluid exiting the outlet impinges upon the mating surfaces of the adjacent seal segments to cool those surfaces. The cooling fluid then flows radially inward and is carried away by working fluid.

Figure 3:
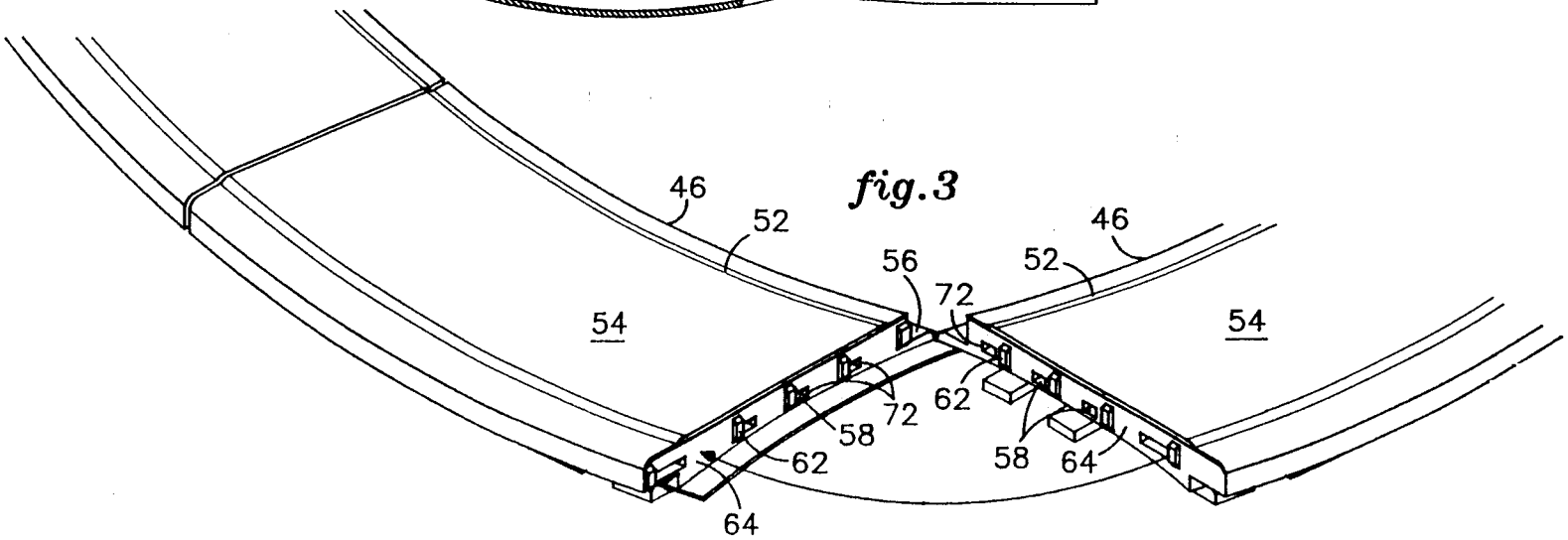
FIG. 3 is a perspective view of a pair of seal segments having individual bumpers adjacent to channel outlets.

The bumpers extend between adjacent mating surfaces to prevent contact between the mating surfaces which could block the flow of cooling fluid exiting the outlets. The bumpers have a height $H_b$measured in the circumferential direction. The height $H_b$ is greater than or equal to the minimum gap $G_{min}$ between adjacent seal segments to ensure adequate cooling flow through the clearance gap G. Each of the bumpers is adjacent to one of the channel outlets to prevent blocking of each outlet. The bumpers also have a radial width $W_b$ measured along a radial axis of the gas turbine engine. The radial width of the bumpers restricts fluid from flowing axially through the clearance gap G. Although shown in FIGS. 2–4 as having bumpers along both lateral edges, it should be apparent to those skilled in the art that a plurality of bumpers may also be disposed along only one lateral edge of a seal segment.

Figure 4A:
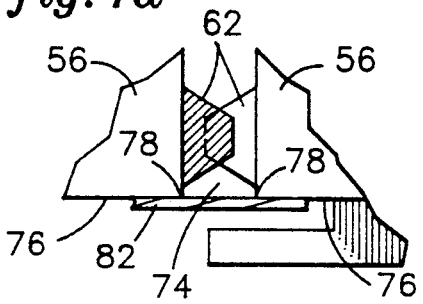
FIG. 4*a* is an axial view of a clearance gap between a pair of adjacent seal segments illustrating the bumpers.
Figure 4B:
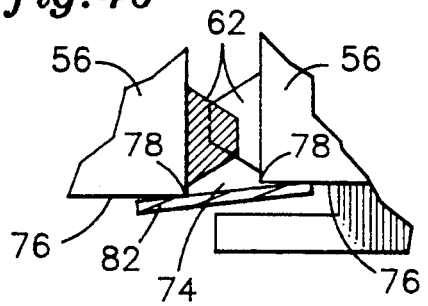
FIG. 4*b* is an axial view of a clearance gap with the seal segments radially misaligned.

As shown in FIG. 4*a* and 4*b*, the bumpers are radially spaced from the outer edge 76 of the seal land. Spacing the bumpers as such provides a smooth and continuous corner 78 for a feather seal 82 to seal against. The feather seal provides means to radially seal the clearance gap G to prevent cooling fluid from flowing radially inward into the gap G. The cooling fluid is thereby encouraged to flow through the channels. In the event of a radial misalignment of adjacent seal segments, as shown in FIG. 4*b*, the feather seal will be engaged with one of the corners 78. Without the radial spacing, the feather seal would be engaged with the bumpers and the bumper edges would provide a crenulate edge with gaps between adjacent bumpers. These gaps would breach the sealing mechanism of the feather seals.

During operation, hot gases exiting the combustion section are expanded in the turbine section and thereby transfer energy to the rotor blades. The outer air seal assembly provides a radially outer boundary for the hot gases to confine the hot gases to the airfoil portion of the rotor blades. As a consequence of the direct contact with the hot gases, the seal segments heat up and the outer air seal assembly expands causing the radial clearance $C_r$ to expand in the radial direction. Expanding the radial clearance $C_r$ allows more of the hot gases to escape around the airfoil portion of the rotor blade and reduces the efficiency of the energy exchange between the hot gases and rotor blades.

Cooling fluid is flowed into the stator assembly, through passages in stator structure, and to the radially outer surface of the seal segment. Channel inlets face radially outward and provide an aperture for cooling fluid to flow into the channels. Since the channels extend circumferentially through the segment, the cooling fluid passing through the channel removes heat from the segment as it flows along the channel. The cooling fluid is then ejected through the channel outlets and into the clearance gap between adjacent segments. Within the clearance gap the cooling fluid cools the mating surfaces defining the clearance gap. The cooling fluid then passes into the flow path of the turbine section and is carried away by working fluid.

The bumpers are sized to prevent the outlets from becoming blocked and to restrict the axial flow of working fluid through the clearance gap. The bumpers are spaced axially and each extends radially such that there is insufficient separation between adjacent bumpers to permit the build up of an axially directed velocity within the clearance gap. In addition, since the source of cooling fluid is typically drawn from the high pressure compressor, the cooling fluid flowing through the stator assembly and out of the channel outlets will typically be at a greater pressure than the working fluid within the turbine section flow path. This pressure difference will also urge the cooling fluid to flow radially inward, through the channels and clearance gap, and into the turbine section.

Figure 5:
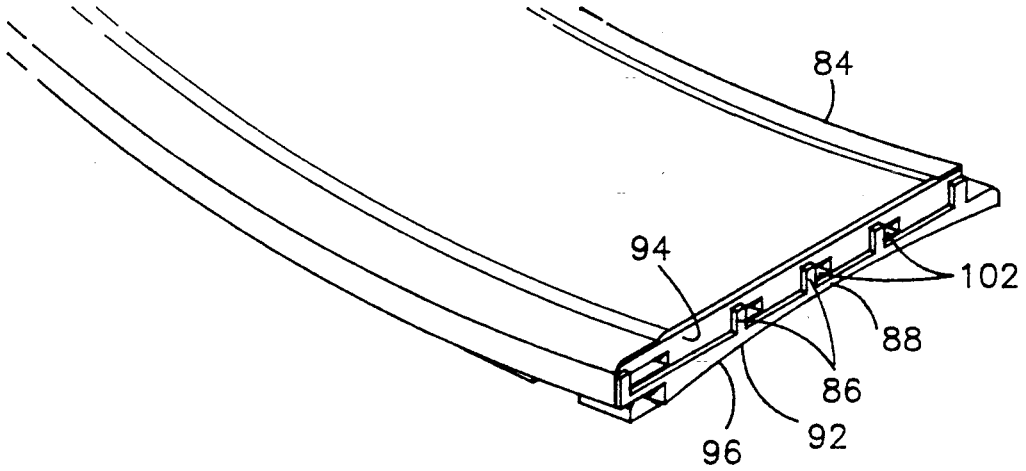
FIG. 5 is a perspective view of a seal segment illustrating a plurality of cooling channels having channel outlets and a plurality of bumpers disposed adjacent to the channel outlets and including a axially extending ridge connecting the plurality of bumpers.
Figure 6A:
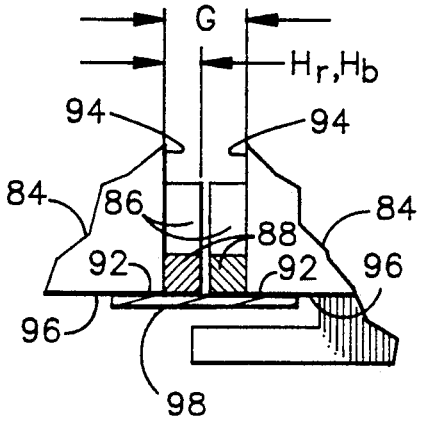
FIG. 6*a* is an axial view of a clearance gap between adjacent seal segments having bumpers including a axially extending ridge.
Figure 6B:
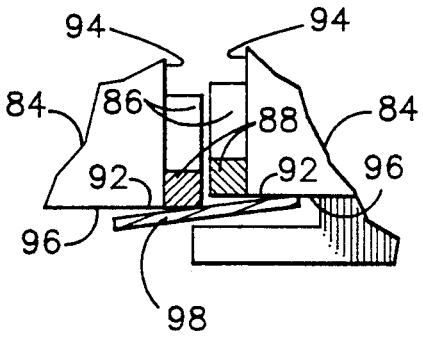
FIG. 6*b* is an axial view of the pair of seal segments shown in FIG. 5*a* with the seal segments radially misaligned.

An alternate embodiment of the present invention is shown in FIGS. 5 and 6. A seal segment 84 includes bumpers 86 and a ridge 88 extending between adjacent seal segments. The bumpers perform the same function as the bumpers shown in FIGS. 1–3 in that they maintain a minimum separation of the clearance gap G to permit adequate cooling flow through the clearance gap G. The ridge extends along the has a height $H_r$ equal to the bumper height $H_b$. The radially outward edge 92 of the mating surface 94 and bumpers and ridge in conjunction urge the fluid within the clearance gap to flow radially inward and into the working fluid flow path. The ridge extends radially outward to a seal land 96. The seal land provides a mating surface for a feather seal 98 extending between adjacent seal segments. The ridge in conjunction with the seal land form a sealing edge which engages the feather seal to prevent a breach if the seal segments become radially misaligned, as shown in FIG. 6*b*. As shown in FIG. 6*a* and 6*b*, the ridge and bumpers are disposed along both lateral edges of the seal segments. In this configuration the ridge height $H_r$ and bumper height $H_b$ are greater than or equal to 0.5 $G_{min}$. In addition, each of the bumpers should be axially aligned with one of the bumpers on the opposing lateral edge to ensure maintenance of a minimum gap. Although shown as disposed on both lateral edges, it should be apparent that the ridge and bumpers may be disposed along only one of the lateral edges. In this configuration, the ridge height $H_r$ and bumper height $H_b$ are greater than or equal to $G_{min}$.

During operation, the ridges provide a barrier against fluid flowing radially outward. Since the channel outlets 102 (see FIG. 5) are radially inward of the ridge, cooling fluid exiting the outlets is urged to flow radially inward and working fluid is discouraged from flowing radially outward. In addition, the ridge provides a smooth and continuous edge for the feather seal to seal against in the event of a radial misalignment as shown in FIG. 6*b*.

The invention is shown in FIGS. 1–7 as means to maintain minimum spacing between adjacent seal segments having cooling channels therein. It should be apparent to those skilled in the art that the invention may be used to maintain minimum spacing between other types of seal segments which require cooling fluid to flow between adjacent seal segments, including seal segments without cooling channels therein.

Although the invention has been shown and described with respect with exemplary embodiments thereof, it should be understood by those skilled in the art that various changes, omissions, and additions may be made thereto, without departing from the spirit and scope of the invention.

What is claimed is:

1. The outer air seal assembly for a gas turbine engine, the gas turbine engine disposed about a longitudinal axis and including an axially disposed flow path and a rotor assembly having a plurality of rotor blades engaged with working fluid within the flow path and adapted to rotate about the longitudinal axis, each rotor blade including a radially outer tip, the outer air seal assembly blocking working fluid from flowing radially outwardly of the rotor blades, the outer air seal assembly including:

a plurality of seal segments, each of the seal segments circumferentially spaced from an adjacent seal segment to define a gap therebetween, each segment having a mating surface facing the adjacent seal segment, the plurality of seal segments forming an annular structure disposed radially outwardly of the rotor assembly, each seal segment including a bumper disposed on and extending circumferentially from the mating surface, the bumper having a height $H_b$ measured circumferentially from the mating surface; and means to flow cooling fluid between adjacent seal segments;

wherein the fluid flowing between adjacent segments flows radially inwardly and into the flow path, wherein the bumper maintains the gap at a minimum distance $G_{min}$, the distance $G_{min}$ selected to permit cooling fluid to flow through the gap.

2. The outer air seal assembly according to claim 1, wherein each of the seal segments further includes a channel extending circumferentially through the segment, the channel including an inlet and an outlet, the channel defining a cooling fluid flow passage, and wherein the means to flow cooling fluid directs cooling fluid into the inlet such that cooling fluid flows through the channel and exits through the outlet.

3. The outer air seal assembly according to claim 2, wherein each segment includes a plurality of circumferentially extending channels and a plurality of bumpers disposed on and extending circumferentially from the mating surface, wherein each bumper is disposed adjacent to one of the channels and wherein at least one of the channels is disposed between adjacent bumpers.

4. The outer air seal assembly according to claim 1, wherein the bumper extends radially between the radially outer surface of the segment and the radially inner surface of the segment, such that the bumper restricts fluid from flowing axially through the gap.

5. The outer air seal assembly according to claim 1, further including a feather seal which extends circumferentially between adjacent seal segments and axially over the clearance gap, and wherein the bumper further includes a ridge disposed radially outwardly of the channels and which extends axially along the mating surface and radially outwardly to a seal land, the ridge and seal land in conjunction defining a sealing edge for the feather seal.

6. The outer air seal assembly according to claim 3, wherein each bumper extends radially between the radially outer surface of the segment and the radially inner surface of the segment, such that the bumpers restricts fluid from flowing axially through the gap.

7. The outer air seal assembly according to claim 3, further including a feather seal which extends circumferentially between adjacent seal segments and axially over the clearance gap, and wherein the bumper further includes a ridge disposed radially outwardly of the channels and which extends axially along the mating surface and radially outward to a seal land, the ridge and seal land in conjunction defining a sealing edge for the feather seal.

8. The outer air seal assembly according to claim 6, wherein the bumper further includes a ridge disposed radially outwardly of the channels and which extends axially along the mating surface, such that the ridge restricts fluid from flowing radially outwardly through the gap and urges cooling fluid exiting the outlet to flow radially inwardly through the gap.

9. A gas turbine engine of the type disposed about a longitudinal axis and including an axially disposed flow path, a rotor assembly having a plurality of rotor blades engaged with working fluid within the flow path and adapted to rotate about the longitudinal axis, each rotor blade including a radially outer tip, and an outer air seal assembly blocking the working fluid from flowing radially outward of the blades wherein the outer air seal assembly includes:

a plurality of seal segments, each of the seal segments circumferentially spaced from an adjacent seal segment to define a gap therebetween, each segment having a mating surface facing the adjacent seal segment, the plurality of seal segments forming an annular structure disposed radially outwardly of the rotor assembly, each seal segment including a bumper disposed on and extending circumferentially from the mating surface, the bumper having a height $H_b$ measured circumferentially from the mating surface; and means to flow cooling fluid between adjacent seal segments;

wherein the fluid flowing between adjacent segments flows radially inwardly and into the flow path, wherein the bumper maintains the gap at a minimum distance $G_{min}$, the distance $G_{min}$ selected to permit cooling fluid to flow through the gap.

10. The gas turbine engine according to claim 9, wherein each of the seal segments further includes a channel extending circumferentially through the segment, the channel including an inlet and an outlet, the channel defining a cooling fluid flow passage, and wherein the means to flow cooling fluid directs cooling fluid into the inlet such that cooling fluid flows through the channel and exits through the outlet.

11. The gas turbine engine according to claim 10, wherein each segment includes a plurality of circumferentially extending channels and a plurality of bumpers disposed on and extending circumferentially from the mating surface, wherein each bumper is disposed adjacent to one of the channels and wherein at least one of the channels is disposed between adjacent bumpers.

12. The gas turbine engine according to claim 9, wherein the bumper extends radially between the radially outer surface of the segment and the radially inner surface of the segment, such that the bumper restricts fluid from flowing axially through the gap.

13. The gas turbine engine according to claim 9, further including a feather seal which extends circumferentially between adjacent seal segments and axially over the clearance gap, and wherein the bumper further includes a ridge disposed radially outwardly of the channels and which extends axially along the mating surface and radially outward to a seal land, the ridge and seal land in conjunction defining a sealing edge for the feather seal.

14. The gas turbine engine according to claim 11, wherein the bumper extends radially between the radially outer surface of the segment and the radially inner surface of the segment, such that the bumper restricts fluid from flowing axially through the gap.

15. The gas turbine engine according to claim 11, further including a feather seal which extends circumferentially between adjacent seal segments and axially over the clearance gap, and wherein the bumper further includes a ridge disposed radially outwardly of the channels and which extends axially along the mating surface and radially outward to a seal land, the ridge and seal land in conjunction defining a sealing edge for the feather seal.

16. The gas turbine engine according to claim 14, wherein the bumper further includes a ridge disposed radially outwardly of the channels and which extends axially along the mating surface, such that the ridge blocks fluid from flowing radially outwardly through the gap and urges cooling fluid exiting the outlet to flow radially inwardly through the gap.

17. A seal segment for a gas turbine engine having an outer air seal assembly, the outer air seal assembly having a plurality of the seal segments, each of the seal segments circumferentially spaced from adjacent seal segments to define a gap therebetween, the plurality of seal segments forming an annular structure, the gas turbine engine having a flowpath and including means to flow cooling fluid between adjacent seal segments, wherein the fluid flowing between adjacent segments flows radially inwardly and into the flow path, the seal segment including:

a mating surface, the mating surface facing an adjacent seal segment of the outer air seal assembly; and a bumper disposed on and extending from the mating surface, the bumper having a height $H_b$ measured from the mating surface, the bumper defining means to maintain the gap at a minimum distance $G_{min}$, the distance $G_{min}$ selected to permit cooling fluid to flow through the gap.

18. The seal segment according to claim 17, further including a channel extending circumferentially through the segment, the channel including an inlet and an outlet, the channel defining a cooling fluid flow passage, and wherein the means to flow cooling fluid directs cooling fluid into the inlet such that cooling fluid flows through the channel and exits through the outlet.

19. The seal segment according to claim 18, wherein the segment includes a plurality of circumferentially extending channels and a plurality of bumpers disposed on and extending circumferentially from the mating surface, wherein each bumper is disposed adjacent to one of the channels and wherein at least one of the channels is disposed between adjacent bumpers.

20. The seal segment according to claim 17, wherein the bumper further includes a ridge disposed outwardly of the channels, and which extends along the mating surface and outwardly to a seal land, the ridge and seal land in conjunction defining a sealing edge for a feather seal.

* * * * *